US009997124B2

(12) United States Patent
Xiao et al.

(10) Patent No.: US 9,997,124 B2
(45) **Date of Patent: *Jun. 12, 2018**

(54) GOA CIRCUITS AND LIQUID CRYSTAL DEVICES

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Juncheng Xiao, Guangdong (CN); Mang Zhao, Guangdong (CN)

(73) Assignees: Shenzhen China Star Optoelectronics Technology Co., Ltd., Shenzhen, Guangdong (CN); Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/802,886

(22) Filed: Nov. 3, 2017

(65) Prior Publication Data

US 2018/0068630 A1 Mar. 8, 2018

Related U.S. Application Data

(62) Division of application No. 14/901,697, filed on Dec. 28, 2015, now Pat. No. 9,818,361.

(51) Int. Cl.
*G09G 3/36* (2006.01)

(52) U.S. Cl.
CPC ... *G09G 3/3677* (2013.01); *G09G 2300/0408* (2013.01); *G09G 2310/0251* (2013.01); *G09G 2310/0283* (2013.01); *G09G 2310/0286* (2013.01); *G09G 2310/061* (2013.01); *G09G 2310/08* (2013.01); *G09G 2330/04* (2013.01)

(58) Field of Classification Search
CPC ... G09G 2310/0286; G09G 2300/0408; G09G 2310/08; G09G 2310/061; G09G 2310/0283; G09G 3/3677; G09G 2330/04; G09G 2310/0251
See application file for complete search history.

(56) References Cited

U.S. PATENT DOCUMENTS

2010/0309191 A1* 12/2010 Hsu ..... G09G 3/3677 345/213
2013/0162508 A1* 6/2013 Li ..... G09G 3/3677 345/92
2016/0086562 A1* 3/2016 Tan ..... G09G 3/3677 345/215

FOREIGN PATENT DOCUMENTS

WO WO 2017031774 A1 * 3/2017 ..... G09G 3/36

* cited by examiner

*Primary Examiner* — Abhishek Sarma
(74) *Attorney, Agent, or Firm* — Andrew C. Cheng

(57) ABSTRACT

A GOA circuit and a liquid crystal device (LCD) are disclosed. The GOA circuit includes a plurality of GOA units and a control module. Each of the cascaded GOA units is configured for charging corresponding horizontal scanning lines within a display area when being driven by a first level clock, a second level clock, a first control clock, and a second control clock. After the horizontal scanning lines are fully charged by the GOA circuit, the control module is configured for resetting the gate driving signals to be at the first level, i.e., the invalid level, via the turn-on pulse signals and the negative-voltage constant-voltage source.

4 Claims, 10 Drawing Sheets

GOA CIRCUITS AND LIQUID CRYSTAL DEVICES

CROSS REFERENCE TO RELATED APPLICATIONS

This is a divisional application of patent application Ser. No. 14/901,697, filed on Dec. 28, 2015, issued as U.S. Pat. No. 9,818,361, on Nov. 14, 2017, which is a national stage of PCT Application Number PCT/CN2015/092361, filed on Oct. 21, 2015, claiming foreign priority of Chinese Patent Application Number 201510629407.5, filed on Sep. 28, 2015.

BACKGROUND OF THE INVENTION

1. Field of the Invention

The present disclosure relates to liquid crystal display technology, and more particularly to a gate driver on array (GOA) circuit and a liquid crystal device (LCD).

2. Discussion of the Related Art

Conventional gate driver on array (GOA) circuit, if incorporated with All Gate On function, the gate driving signals may not transit to the invalid level immediately after the All Gate On function is completed. As such, redundant gate driving signals may be generated, which may cause the circuit to be invalid.

With respect to All Gate On function, all of the gate driving signals within the GOA circuit is configured to be at a valid level such that all of the horizontal scanning lines may be charged at the same time. In this way, residual charges within each of the pixels may be cleaned and thus the blue issue occurring when the LCD boots up may be resolved.

Signal lines of turn-on pulse signals (STV) are configured to pull down the P point to resolve the Holding issue of Gate signals. The current loaded by the signal line of the turn-on pulse signals (STV) is the sum of the current from all of the branches. When a high PPI panel is driven, the current on the STV signal line may reach a great level, at this moment, the STV signal line may blow out and the GOA driving circuit may be invalid. Thus, the width of the STV wiring has to be increased so as to increase the driving capability of the STV signal line. However, as the route of STV signal line is limited by the GOA layout, a larger electrostatic force may be in company with the increasing of the width of the signal line. The accumulated electrostatic force may cause the blow out of the STV signal line. Thus, the circuit has to be effectively designed to reduce the loading of the STV signal line so as to ensure the normal pull-down of the P point.

SUMMARY

The object of the invention is to provide a GOA circuit and a LCD. Before the first gate driving signals are outputted, the horizontal scanning line may not generate redundant pulse signals. At the same time, the load on the signals line for activating the pulse signals may be reduced so as to prevent the signals line from blowout due to overload.

In one aspect, a gate driver on array (GOA) circuit of liquid crystal devices (LCDs) includes: a plurality of cascaded GOA units, each of the cascaded GOA units is configured for charging corresponding horizontal scanning lines within a display area when being driven by a first level clock, a second level clock, a first control clock, and a second control clock, the first level clock and the second level clock are configured for controlling an input of level signals of the GOA unit and for controlling generation of gate driving signals, the first control clock and the second control clock are configured for controlling the gate driving signals to be at a first level, and wherein the level signals are turn-on pulse signals or the gate driving signals of adjacent GOA units; and after the horizontal scanning lines have been charged completely by the GOA circuit, a control module is configured for resetting the gate driving signals, except for the first gate driving signals, to be the first level via the turn-on pulse signals and a negative-voltage constant-voltage source, before the first gate driving signals are outputted, the horizontal scanning lines are prevented from generating redundant pulse signals, at the same time, load on a signal line of the turn-on pulse signals is decreased, the negative-voltage constant-voltage source is configured for providing constant low level signals for each of the GOA units.

Wherein the GOA unit includes a forward-backward scanning unit, an input control unit, a pull-up maintaining unit, an output control unit, a GAS signal operation unit, and a bootstrap capacitance unit; the forward-backward scanning unit is configured for controlling a forward driven method or a backward driven method of the GOA circuit to maintain the common signal point at a second level in response to the first control clock or the second control clock; the input control unit is configured for charging the gate signal point after the first level clock controls an input of the level signals; the pull-up maintaining unit is configured for maintaining the gate signal point to be at the first level during a non-operation period in accordance with the common signal point; the output control unit controls the output of the gate driving signals corresponding to the gate signal point in accordance with the second level clock; the GAS signal operation unit controls the gate driving signals to be at the second level so as to charge the horizontal scanning line corresponding to the GOA unit; and the bootstrap capacitance unit lifts a voltage of the gate signal point.

Wherein the control module includes a first controllable transistor, a first end of the first controllable transistor connects with the negative-voltage constant-voltage source, and a second end of the first controllable transistor connects with the signal line of the turn-on pulse signals to receive the turn-on pulse signals, a third end of the first controllable transistor respectively connects to the common signal points of each of the GOA units except for the first GOA unit.

Wherein the control module includes a first controllable transistor and a second controllable transistor, a first end of the first controllable transistor connects with the negative-voltage constant-voltage source, a second end of the first controllable transistor connects with the signal line of the turn-on pulse signals, a third end of the first controllable transistor connects to the first end and the second end of the second controllable transistor, and a third end of the second controllable transistor respectively connects with the common signal points of each of the GOA units at all of the levels, except for the first level.

Wherein a control module includes a first controllable transistor, a second controllable transistor, and a third controllable switch, a first end of the third controllable switch connects to the turn-on pulse signals, a second end of the third controllable switch connects to the negative-voltage constant-voltage source, a third end of the third controllable switch connects to the second end of the first controllable transistor, the first end of the first controllable transistor connects to the negative-voltage constant-voltage source, a third end of the first controllable transistor connects to a first end and a second end of the second controllable transistor, a third end of the second controllable transistor respectively connects to the common signal points of each of the GOA units, except for the first GOA unit.

Wherein the control module includes a plurality of first controllable transistors corresponding to each of the GOA units one by one except for the first GOA unit, the first ends of the first controllable transistors connect with the negative-voltage constant-voltage source, the second ends of the first controllable transistors connect with a signal line of the turn-on pulse signals, third ends of the first controllable transistors connect with the common signal points of the corresponding GOA units.

Wherein the control module includes a plurality of first controllable transistors and a plurality of second controllable transistors corresponding to each of the GOA units one by one except for the first GOA unit, the first ends of the first controllable transistors connect to the negative-voltage constant-voltage source, the second ends of the first controllable transistor connect to a signal line of the turn-on pulse signals, the third ends of the third controllable transistors connect to a first end and a second end of the second controllable transistor, and third ends of the second controllable transistors connect to the gate signal points of the corresponding GOA unit.

Wherein the control module includes a plurality of first controllable transistors, a plurality of second controllable transistors, and a plurality of third controllable transistors corresponding to each of the GOA units one by one except for the first GOA unit, the first ends of the third controllable transistors connect to the turn-on pulse signals, the second ends of the third controllable transistors connect to the negative-voltage constant-voltage source, the third ends of the third controllable transistors connect to a second ends of the first controllable transistors, first ends of the first controllable transistors connect to the negative-voltage constant-voltage source, third ends of the first controllable transistors connect to first ends and second ends of the second controllable transistor, and third ends of the second controllable transistors respectively connect to the common signal points of the corresponding GOA unit.

Wherein the forward-backward scanning unit includes a first transistor, a second transistor, a third transistor and a fourth transistor, a gate of the first transistor receives the first scanning control signals, a source of the first transistor receives the gate driving signals outputted by the GOA unit at the next level, a gate of the second transistor receives the second scanning control signals, a source of the second transistor receives the gate driving signals outputted from the GOA unit at the previous level, drains of the first transistor and the second transistor are connected and then connect to the input control unit, a gate of the third transistor receives the first scanning control signals, a source of the third transistor receives the first control clock, a gate of the fourth transistor receives the second scanning control signals, a source of the fourth transistor receives the second control clock, drains of the third transistor and the fourth transistor are connected and then connect with the pull-up maintaining unit; the input control unit includes a fifth transistor, a gate of the fifth transistor receives the first level clock, a source of the fifth transistor connects with drains of the first transistor and the second transistor, and a drain of the fifth transistor connects with the gate signal point; the pull-up maintaining unit includes a sixth transistor, a seventh transistor, a ninth transistor, and a tenth transistor, and a first capacitor, a gate of the sixth transistor connects with the common signal point, a source of the sixth transistor connects with a drain of the fifth transistor, a drain of the sixth transistor connects with the first constant voltage source, a gate of the seventh transistor connects with the drain of the fifth transistor, a source of the seventh transistor connects with the common signal point, a drain of the seventh transistor connects with the first constant voltage source, a gate of the ninth transistor connects with the drains of the third transistor and the fourth transistor, a source of the ninth transistor connects with the second constant voltage source, a drain of the ninth transistor connects with the common signal point, a gate of the tenth transistor connects with the common signal point, a source of the tenth transistor connects with the gate driving signals, a drain of the tenth transistor connects with the first constant voltage source, one end of the first capacitor connects with the first constant voltage source, and the other end of the first capacitor connects with the common signal point; the output control unit includes an eleventh transistor and a second capacitor, a gate of the eleventh transistor connects with the gate signal point, a drain of the eleventh transistor connects with the gate signal point, a source of the eleventh transistor receives the second level clock, one end of the second capacitor connects with the gate signal point, and the other end of the second capacitor connects with the gate driving signals; the GAS signal operation unit includes a thirteenth transistor and a fourteenth transistor, a gate of the thirteenth transistor and a gate and a drain of the fourteenth transistor receive the GAS signals, a drain of the thirteenth transistor receives the first constant voltage source, a source of the thirteenth transistor connects with the common signal point, and a source of the fourteenth transistor connects with the gate driving signals; the bootstrap capacitance unit includes a bootstrap capacitance, one end of the bootstrap capacitance connects with the gate driving signals, and the other end of the bootstrap capacitance connects with ground signals; the GOA unit further includes a regulation unit and a pull-up auxiliary unit, the regulation unit includes an eighth transistor connecting between the source of the fifth transistor and the gate signal point, a gate of the eighth transistor connects with the second constant voltage source, a drain of the eighth transistor connects with the drain of the fifth transistor, and a source of the eighth transistor connects with the gate signal point; and the pull-up auxiliary unit includes a twelfth transistor, a gate of the twelfth transistor connects with drains of the first transistor and the second transistor, a source of the twelfth transistor connects with the common signal point, and a drain of the twelfth transistor connects with the positive-voltage constant-voltage source.

In another aspect, a liquid crystal device (LCD) includes: a GOA circuit having a plurality of cascaded GOA units, each of the cascaded GOA units is configured for charging corresponding horizontal scanning lines within a display area when being driven by a first level clock, a second level clock, a first control clock, and a second control clock, the first level clock and the second level clock are configured for controlling an input of level signals of the GOA unit and for controlling generation of gate driving signals, the first control clock and the second control clock are configured for controlling the gate driving signals to be at a first level, and wherein the level signals are turn-on pulse signals or the gate driving signals of adjacent GOA units; and after the horizontal scanning lines have been charged completely by the GOA circuit, a control module is configured for resetting the gate driving signals, except for the first gate driving signals, to be the first level via the turn-on pulse signals and a negative-voltage constant-voltage source, before the first gate driving signals are outputted, the horizontal scanning lines are prevented from generating redundant pulse signals, at the same time, load on a signal line of the turn-on pulse signals is decreased, the negative-voltage constant-voltage source is configured for providing constant low level signals for each of the GOA units.

Wherein the GOA unit includes a forward-backward scanning unit, an input control unit, a pull-up maintaining unit, an output control unit, a GAS signal operation unit, and a bootstrap capacitance unit; the forward-backward scanning unit is configured for controlling a forward driven method or a backward driven method of the GOA circuit to maintain the common signal point at a second level in response to the first control clock or the second control clock; the input control unit is configured for charging the gate signal point after the first level clock controls an input of the level signals; the pull-up maintaining unit is configured for maintaining the gate signal point Q to be at the first level during a non-operation period in accordance with the common signal point; the output control unit controls the output of the gate driving signals corresponding to the gate signal point in accordance with the second level clock; the GAS signal operation unit controls the gate driving signals to be at the second level so as to charge the horizontal scanning line corresponding to the GOA unit; and the bootstrap capacitance unit lifts a voltage of the gate signal point.

Wherein the control module includes a first controllable transistor, a first end of the first controllable transistor connects with the negative-voltage constant-voltage source, and a second end of the first controllable transistor connects with the signal line of the turn-on pulse signals to receive the turn-on pulse signals, a third end of the first controllable transistor respectively connects to the common signal points of each of the GOA units except for the first GOA unit.

Wherein the control module includes a first controllable transistor and a second controllable transistor, a first end of the first controllable transistor connects with the negative-voltage constant-voltage source, a second end of the first controllable transistor connects with the signal line of the turn-on pulse signals, a third end of the first controllable transistor connects to the first end and the second end of the second controllable transistor, and a third end of the second controllable transistor respectively connects with the common signal points of each of the GOA units at all of the levels, except for the first level.

Wherein a control module includes a first controllable transistor, a second controllable transistor, and a third controllable switch, a first end of the third controllable switch connects to the turn-on pulse signals, a second end of the third controllable switch connects to the negative-voltage constant-voltage source, a third end of the third controllable switch connects to the second end of the first controllable transistor, the first end of the first controllable transistor connects to the negative-voltage constant-voltage source, a third end of the first controllable transistor connects to a first end and a second end of the second controllable transistor, a third end of the second controllable transistor respectively connects to the common signal points of each of the GOA units, except for the first GOA unit.

Wherein the control module includes a plurality of first controllable transistors corresponding to each of the GOA units one by one except for the first GOA unit, the first ends of the first controllable transistors connect with the negative-voltage constant-voltage source, the second ends of the first controllable transistors connect with a signal line of the turn-on pulse signals, the third ends of the first controllable transistors connect with the common signal points of the corresponding GOA units.

Wherein the control module includes a plurality of first controllable transistors and a plurality of second controllable transistors corresponding to each of the GOA units one by one except for the first GOA unit, the first ends of the first controllable transistors connect to the negative-voltage constant-voltage source, the second ends of the first controllable transistor connect to a signal line of the turn-on pulse signals, the third ends of the third controllable transistors connect to a first end and a second end of the second controllable transistor, and third ends of the second controllable transistors connect to the gate signal points of the corresponding GOA unit.

Wherein the control module includes a plurality of first controllable transistors, a plurality of second controllable transistors, and a plurality of third controllable transistors corresponding to each of the GOA units one by one except for the first GOA unit, first ends of the third controllable transistors connect to the turn-on pulse signals, the second ends of the third controllable transistors connect to the negative-voltage constant-voltage source, the third ends of the third controllable transistors connect to a second ends of the first controllable transistors, first ends of the first controllable transistors connect to the negative-voltage constant-voltage source, third ends of the first controllable transistors connect to first ends and second ends of the second controllable transistor, and third ends of the second controllable transistors respectively connect to the common signal points of the corresponding GOA unit.

Wherein the forward-backward scanning unit includes a first transistor, a second transistor, a third transistor and a fourth transistor, a gate of the first transistor receives the first scanning control signals, a source of the first transistor receives the gate driving signals outputted by the GOA unit at the next level, a gate of the second transistor receives the second scanning control signals, a source of the second transistor receives the gate driving signals outputted from the GOA unit at the previous level, drains of the first transistor and the second transistor are connected and then connect to the input control unit, a gate of the third transistor receives the first scanning control signals, a source of the third transistor receives the first control clock, a gate of the fourth transistor receives the second scanning control signals, a source of the fourth transistor receives the second control clock, drains of the third transistor and the fourth transistor are connected and then connect with the pull-up maintaining unit; the input control unit includes a fifth transistor, a gate of the fifth transistor receives the first level clock, a source of the fifth transistor connects with drains of the first transistor and the second transistor, and a drain of the fifth transistor connects with the gate signal point; the pull-up maintaining unit includes a sixth transistor, a seventh transistor, a ninth transistor, and a tenth transistor, and a first capacitor, a gate of the sixth transistor connects with the common signal point, a source of the sixth transistor connects with a drain of the fifth transistor, a drain of the sixth transistor connects with the first constant voltage source, a gate of the seventh transistor connects with the drain of the fifth transistor, a source of the seventh transistor connects with the common signal point, a drain of the seventh transistor connects with the first constant voltage source, a gate of the ninth transistor connects with the drains of the third transistor and the fourth transistor, a source of the ninth transistor connects with the second constant voltage source, a drain of the ninth transistor connects with the common signal point, a gate of the tenth transistor connects with the common signal point, a source of the tenth transistor connects with the gate driving signals, a drain of the tenth transistor connects with the first constant voltage source, one end of the first capacitor connects with the first constant voltage source, and the other end of the first capacitor connects with the common signal point; the output control unit includes an eleventh transistor and a second capacitor, a gate of the eleventh transistor connects with the gate signal point, a drain of the eleventh transistor connects with the gate signal point, a source of the eleventh transistor receives the second level clock, one end of the second capacitor connects with the gate signal point, and the other end of the second capacitor connects with the gate driving signals; the GAS signal operation unit includes a thirteenth transistor and a fourteenth transistor, a gate of the thirteenth transistor and a gate and a drain of the fourteenth transistor receive the GAS signals, a drain of the thirteenth transistor receives the first constant voltage source, a source of the thirteenth transistor connects with the common signal point, and a source of the fourteenth transistor connects with the gate driving signals; the bootstrap capacitance unit includes a bootstrap capacitance, one end of the bootstrap capacitance connects with the gate driving signals, and the other end of the bootstrap capacitance connects with ground signals; the GOA unit further includes a regulation unit and a pull-up auxiliary unit, the regulation unit includes an eighth transistor connecting between the source of the fifth transistor and the gate signal point, a gate of the eighth transistor connects with the second constant voltage source, a drain of the eighth transistor connects with the drain of the fifth transistor, and a source of the eighth transistor connects with the gate signal point; and the pull-up auxiliary unit includes a twelfth transistor, a gate of the twelfth transistor connects with drains of the first transistor and the second transistor, a source of the twelfth transistor connects with the common signal point, and a drain of the twelfth transistor connects with the positive-voltage constant-voltage source.

In view of the above, after the horizontal scanning lines are fully charged by the GOA circuit, the gate driving signals of the horizontal scanning line are controlled by turning on the turn-on pulse signals (STV) to be reset to be at the first level, i.e., the invalid level. As such, the horizontal scanning line is prevented from generating redundant pulse signals before the first gate driving signals are outputted, which guarantee the normal operations of the GOA circuit. At the same time, as the turn-on pulse signals (STV) and the negative-voltage constant-voltage source (VGL) cooperatively control the gate driving signals GATE (N) other than the first gate driving signals GATE (1) to be reset to the first level, the loading on the signals lines is reduced, compared to the condition that only the turn-on pulse signals (STV) is adopted. The current passing through the control module is loaded by the signals line of the negative-voltage constant-voltage source (VGL). The width of the VGL signal line is larger, and the route of the VGL signal line is close to the layout of the GOA circuit. The electrostatic force to be borne is small, and thus the driving capability is strong. The VGL signal line is durable for larger current and thus is not fragile.

DETAILED DESCRIPTION OF THE EMBODIMENTS

Among the specification and the scope of subsequent terms are used to refer to specific components. Those of skill in the art will appreciate that manufacturers may use different terms to refer to the same components. The patent specification and subsequent differences in the name of the range is not to be used as a way to distinguish between the components, but with differences in the functional components as distinguished benchmarks. Embodiments of the invention will now be described more fully hereinafter with reference to the accompanying drawings, in which embodiments of the invention are shown.

Figure 1:
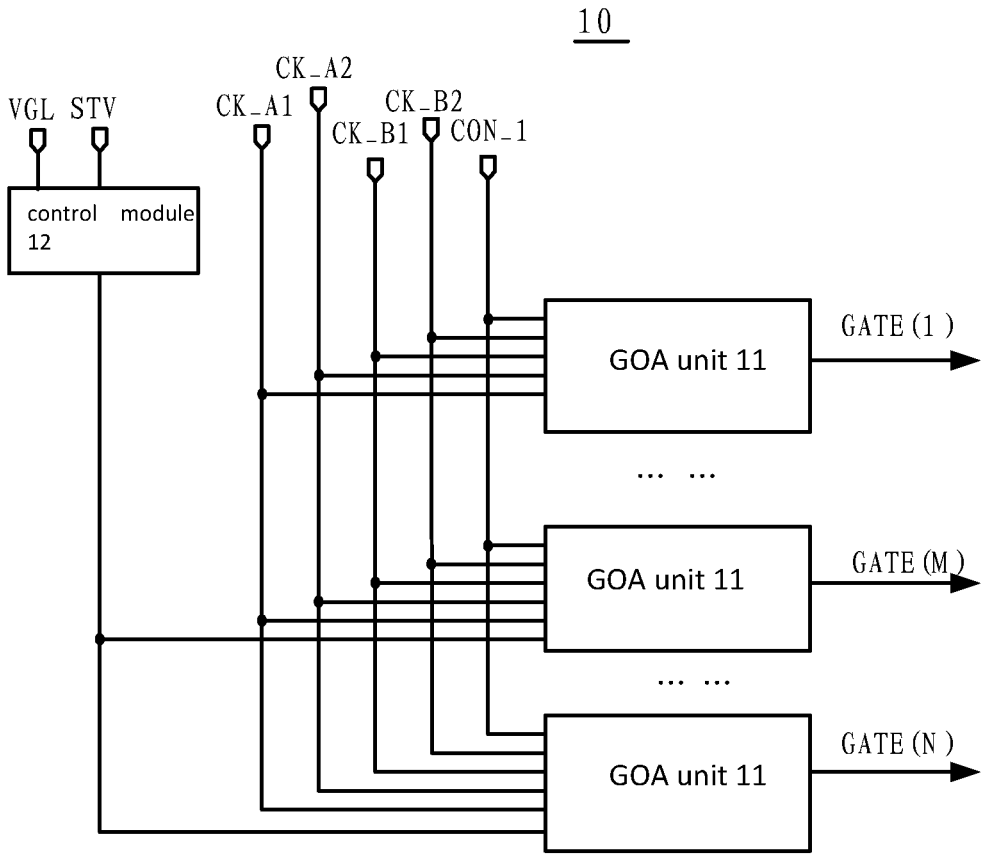
FIG. 1 is a schematic view of the GOA circuit in accordance with a first embodiment.

FIG. 1 is a schematic view of the GOA circuit in accordance with a first embodiment. As shown in FIG. 1, the GOA circuit 10 includes a plurality of cascaded GOA units 11 and a control module 12.

Each of the cascaded GOA units 11 is configured for charging corresponding horizontal scanning line within a display area when being driven by a first level clock (CK_A1), a second level clock (CK_A2), a first control clock (CK_B1), and a second control clock (CK_B2). The first level clock (CK_A1) and the second level clock (CK_A2) are configured for controlling an input of level signals (CON_1) of the GOA unit 11 and for controlling the generation of the gate driving signals GATE (N), wherein N is a natural number. The first control clock (CK_B1) and the second control clock (CK_B2) are configured for controlling the gate driving signals GATE (N) to be at a first level, i.e., an invalid level. The level signals (CON_1) may be turn-on pulse signals or the gate driving signals of adjacent GOA units 11.

The control module 12 respectively connects to the turn-on pulse signals (STV), a negative-voltage constant-voltage source (VGL), and each of the GOA units 11 except for the first GOA unit 11. After the horizontal scanning lines have been charged completely by the GOA circuit 10, that is, the All Gate on function is completed, the control module 12 is configured for resetting the gate driving signals GATE (N), except the first gate driving signals GATE (1), to be the first level via the turn-on pulse signals (STV) and the negative-voltage constant-voltage source (VGL). In this way, before the first gate driving signals GATE (1) are outputted, the horizontal scanning line is prevented from generating the pulse signals. At the same time, as the turn-on pulse signals (STV) and the negative-voltage constant-voltage source (VGL) cooperatively control the gate driving signals GATE (N) other than the first gate driving signals GATE (1) to be reset to the first level, the loading on the signals lines is reduced, compared to the condition that only the turn-on pulse signals (STV) is adopted. The negative-voltage constant-voltage source (VGL) is configured for providing constant low level signals for each of the GOA units. The current passing through the control module is loaded by the signals line of the negative-voltage constant-voltage source (VGL). The width of the VGL signal line is larger, and the route of the VGL signal line is close to the layout of the GOA circuit. The electrostatic force to be borne is small, and thus the driving capability is strong. The VGL signal line is durable for larger current and thus is not fragile.

Figure 2:
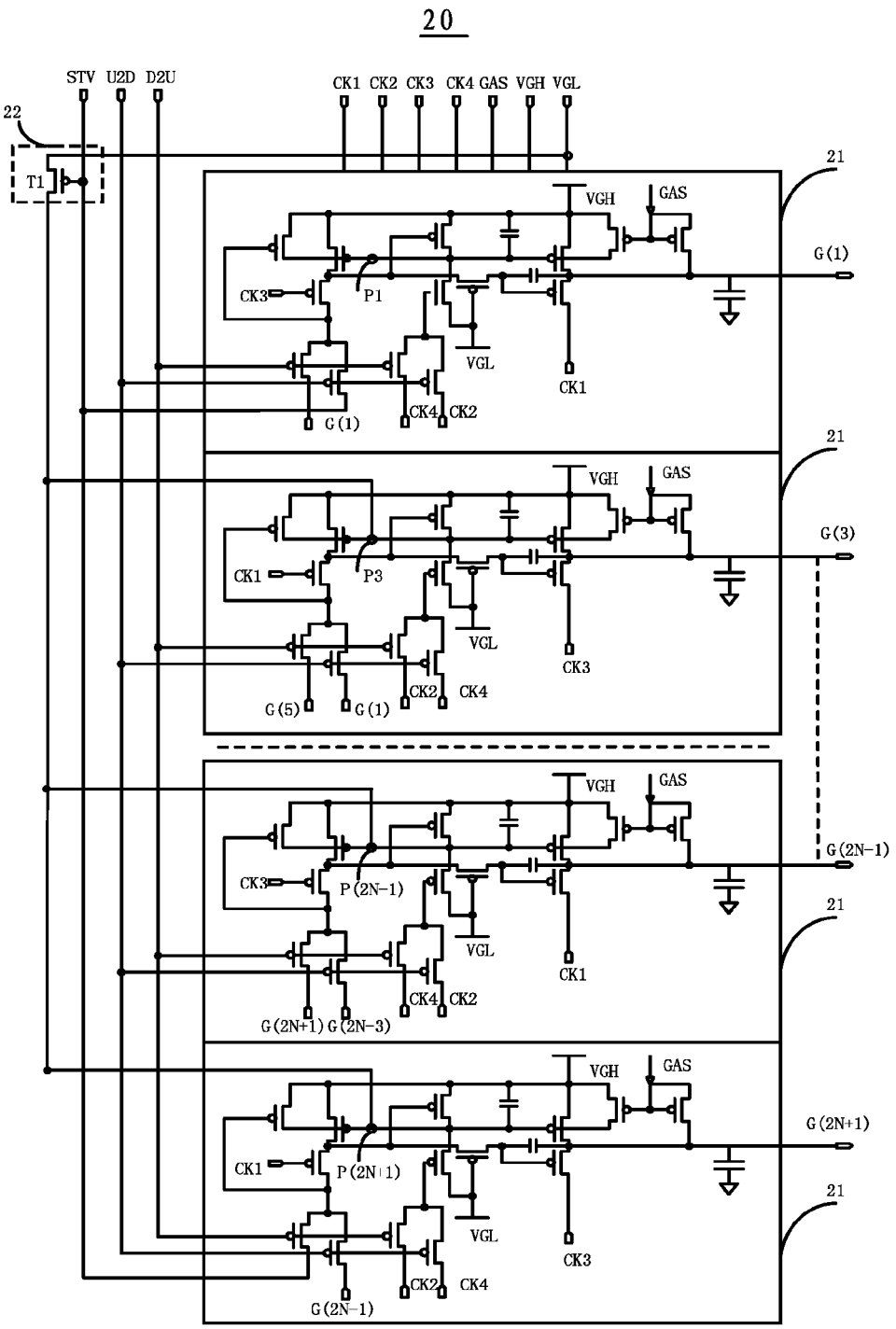
FIG. 2 is a schematic view of the GOA circuit in accordance with a second embodiment.

FIG. 2 is a schematic view of the GOA circuit in accordance with a second embodiment. In this embodiment, the GOA circuit is formed by GOA units at odd levels, and the GOA circuit is a PMOS circuit. As shown in FIG. 2, the GOA circuit 20 includes the GOA units at odd levels 21 and a control module 22.

The GOA circuit 20 includes the cascaded GOA units at odd levels 21. That is, the GOA circuit 20 includes the GOA units 21 at the first, the third, the fifth, and the (2N+1)-th level, and the GOA units 21 are cascaded.

The GOA circuit 20 receives the first clock signals (CK1), the second clock signals (CK2), the third clock signals (CK3), and the fourth clock signals (CK4). The first clock signals (CK1), the second clock signals (CK2), the third clock signals (CK3), and the fourth clock signals (CK4) are respectively valid within one clock period in sequence.

Figure 3:
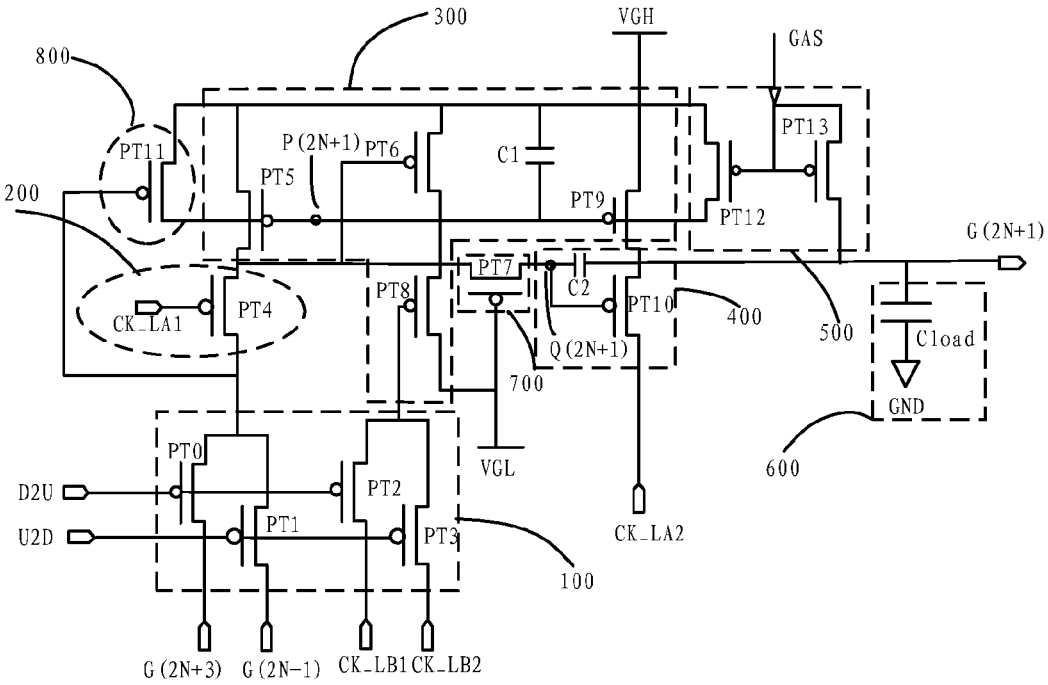
FIG. 3 is a circuit diagram of the GOA unit of the GOA circuit of FIG. 2.

FIG. 3 is a circuit diagram of the GOA unit of the GOA circuit of FIG. 2. The GOA unit 21 includes a forward-backward scanning unit 100, an input control unit 200, a pull-up maintaining unit 300, an output control unit 400, a GAS signal operation unit 500, and a bootstrap capacitance unit 600.

The forward-backward scanning unit 100 is configured for controlling the forward driven method or backward driven method of the GOA circuit 20. In addition, in response to the first control clock (CK_LB1) or the second control clock (CK_LB2), a common signal point P(2N+1) is controlled to be maintained at the second level. In the embodiment, the second level is low level.

The input control unit 200 is configured for charging the gate signal point Q(2N+1) after the first level clock (CK_LA1) controls the input of the level signals, wherein N is the natural number.

The pull-up maintaining unit 300 is configured for maintaining the gate signal point Q(2N+1) to be at the first level during a non-operation period in accordance with the common signal point P(2N+1). In the embodiment, the first level is high level.

The output control unit 400 controls the output of the gate driving signals G(2N+1) corresponding to the gate signal point Q(2N+1) in accordance with the second level clock (CK_LA2)

The GAS signal operation unit 500 controls the gate driving signals G(2N+1) to be at the valid level so as to charge the horizontal scanning line corresponding to the GOA unit 21. In the embodiment, the valid level of the gate driving signals G(2N+1) is the low level.

The bootstrap capacitance unit 600 further lifts the voltage of the gate signal point Q(2N+1).

Specifically, the forward-backward scanning unit 100 includes a first transistor (PT0), a second transistor (PT1), and a third transistor (PT2) and a fourth transistor (PT3). The gate of the first transistor (PT0) receives the first scanning control signals, i.e., backward scanning signals (D2U). The source of the first transistor (PT0) receives the gate driving signals G(2N+3) outputted by the GOA unit 21 at the next level. The gate of the second transistor (PT1) receives the second scanning control signals, i.e., forward scanning control signals (U2D), and the source of the second transistor (PT1) receives the gate driving signals G(2N−1) outputted from the GOA unit at the previous level. The drains of the first transistor (PT0) and the second transistor (PT1) are connected and then connect to the input control unit 200. The gate of the third transistor (PT2) receives the first scanning control signals, i.e., backward scanning signals (D2U). The source of the third transistor (PT2) receives the first control clock (CK_LB1), the gate of the fourth transistor (PT3) receives the second scanning control signals, i.e., the forward scanning control signals (U2D), the source of the fourth transistor (PT3) receives the second control clock (CK_LB2), the drains of the third transistor (PT2) and the fourth transistor (PT3) are connected and then connect with the pull-up maintaining unit 300.

Regarding the GOA unit at the first level, the source of the second transistor (PT1) receives the turn-on pulse signals (STV). Regarding the GOA unit at the final level, the source of the first transistor (PT0) receives the turn-on pulse signals (STV).

The input control unit 200 includes a fifth transistor (PT4), a gate of the fifth transistor (PT4) receives the first level clock (CK_LA1), a source of the fifth transistor (PT4) connects with the drains of the first transistor (PT0) and the second transistor (PT1), and the drain of the fifth transistor (PT4) connects with the gate signal point Q(2N+1).

The pull-up maintaining unit 300 includes a sixth transistor (PT5), a seventh transistor (PT6), a ninth transistor (PT8), and a tenth transistor (PT9), and a first capacitor (C1). A gate of the sixth transistor (PT5) connects with the common signal point P(2N+1), a source of the sixth transistor (PT5) connects with the drain of the fifth transistor (PT4), a drain of the sixth transistor (PT5) connects with the first constant voltage source, i.e., the positive-voltage constant-voltage source (VGH), a gate of the seventh transistor (PT6) connects with the drain of the fifth transistor (PT4), a source of the seventh transistor (PT6) connects with the common signal point P(2N+1), a drain of the seventh transistor (PT6) connects with the first constant voltage source, i.e., the positive-voltage constant-voltage source (VGH), a gate of the ninth transistor (PT8) connects with the drains of the third transistor (PT2) and the fourth transistor (PT3), a source of the ninth transistor (PT8) connects with the second constant voltage source, i.e., the negative-voltage constant-voltage source (VGL), a drain of the ninth transistor (PT8) connects with the common signal point P(2N+1), a gate of the tenth transistor (PT9) connects with the common signal point, a source of the tenth transistor (PT9) connects with the gate driving signals, a drain of the tenth transistor (PT9) connects with the first constant voltage source, i.e., the positive-voltage constant-voltage source (VGH). One end of the first capacitor (C1) connects with the first constant voltage source, i.e., the positive-voltage constant-voltage source (VGH), and the other end of the first capacitor (C1) connects with the common signal point P(2N+1).

The output control unit 400 includes an eleventh transistor (PT10) and a second capacitor (C2). A gate of the eleventh transistor (PT10) connects with the gate signal point Q(2N+1), a drain of the eleventh transistor (PT10) connects with the gate signal point Q(2N+1), a source of the eleventh transistor (PT10) receives the second level clock (CK_LA2), one end of the second capacitor (C2) connects with the gate signal point Q(2N+1), and the other end of the second capacitor (C2) connects with the gate driving signals G(2N+1).

The GAS signal operation unit 500 includes a thirteenth transistor (PT12) and a fourteenth transistor (PT13). A gate of the thirteenth transistor (PT12) and a gate and a drain of the fourteenth transistor (PT13) receive the GAS signals (GAS), a drain of the thirteenth transistor (PT12) receives the first constant voltage source, i.e., the positive-voltage constant-voltage source (VGH), a source of the thirteenth transistor (PT12) connects with the common signal point P(2N+1), a source of the thirteenth transistor (PT12) connects with the gate driving signals G(2N+1).

The bootstrap capacitance unit 600 includes a bootstrap capacitance (Cload). One end of the bootstrap capacitance (Cload) connects with the gate driving signals G(2N+1), and the other end of the bootstrap capacitance (Cload) connects with the ground signals (GND).

Preferably, the GOA unit 21 further includes a regulation unit 700 for regulating the voltage of the gate signal point Q(2N+1) and for preventing electric leakage of the gate signal point Q(2N+1). Specifically, the regulation unit 700 includes an eighth transistor (PT7) connecting between the source of the fifth transistor (PT4) and the gate signal point Q(2N+1). A gate of the eighth transistor (PT7) connects with the second constant voltage source, i.e., the negative-voltage constant-voltage source (VGL), a drain of the eighth transistor (PT7) connects with the drain of the fifth transistor (PT4), and a source of the eighth transistor (PT7) connects with the gate signal point Q(2N+1).

Preferably, the GOA unit 21 includes a pull-up auxiliary unit 800 for preventing the electric leakage when the fifth transistor (PT4) and the sixth transistor (PT5) charge the gate signal point Q(2N+1). Specifically, the pull-up auxiliary unit 800 includes a twelfth transistor (PT11). A gate of the twelfth transistor (PT11) connects with the drains of the first transistor (PT0) and the second transistor (PT1), a source of the twelfth transistor (PT11) connects with the common signal point P(2N+1), and a drain of the twelfth transistor (PT11) connects with the first constant voltage source, i.e., the positive-voltage constant-voltage source (VGH).

With respect to the GOA units 21 at the 1st, 5th, . . . (4N+1)-th level, the first level clock (CK_LA1) is the first clock signals (CK1), the second level clock (CK_LA2) is the third clock signals (CK3), the first control clock (CK_LB1) is the second clock signals (CK2), the second control clock (CK_LB2) is the fourth clock signals (CK4), wherein N is the natural number. With respect to the GOA units 21 at the 3rd, 7th, . . . (4N+3)-th levels, the second level clock (CK_LA2) is the third clock signals (CK3), the first level clock (CK_LA1) is the first clock signals (CK1), the second control clock (CK_LB2) is the fourth clock signals (CK4), and the second control clock (CK_LB2) is the second clock signals (CK2), wherein N is the natural number.

It can be understood that when the GOA circuit is the NMOS circuit, the above transistors are NMOS transistors, the first scanning control signals are the forward scanning control signals (U2D), the second scanning control signals are the backward scanning signals (D2U), the first constant voltage source corresponds to the negative-voltage constant-voltage source (VGL), and the second constant voltage source corresponds to the positive-voltage constant-voltage (VGH).

Referring to FIG. 2, the control module 22 includes a first controllable transistor (T1). A first end of the first controllable transistor (T1) connects with the negative-voltage constant-voltage source (VGL), and a second end of the first controllable transistor (T1) connects with the signal line of the turn-on pulse signals (STV) to receive the turn-on pulse signals (STV). A third end of the first controllable transistor (T1) respectively connects to the common signal points P(2N+1) of each of the GOA units 21 except for the first GOA unit 21.

In the embodiment, the first controllable transistor (T1) is the PMOS transistor, the first, second, and third ends of the first controllable transistor (T1) corresponds to the drain, gate and source of the PMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the low level such that the gate driving signals G(2N+1) of the horizontal scanning line are reset to be at the high level.

The turn-on pulse signals (STV) are turned on to control the gate of the first controllable transistor (T1), and the signal line of the negative-voltage constant-voltage source (VGL) is adopted to control the drain of the first controllable transistor (T1). As such, the current of the first controllable transistor (T1) is loaded by the signal line of the negative-voltage constant-voltage source (VGL). The width of the scanning line of the negative-voltage constant-voltage source (VGL) is larger, and the route of the negative-voltage constant-voltage source (VGL) is close to the layout of the GOA unit. The electrostatic force to be borne is small, and thus the driving capability is strong. The VGL signal line is durable for larger current and thus is not fragile.

In other embodiments, when the GOA circuit is the NMOS circuit, the first controllable transistor (T1) may be the NMOS transistor. The first, the second, and the third ends of the first controllable transistor (T1) correspond to the drain, the gate, and the source of the NMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the high level such that the gate driving signals G(2N+1) of the horizontal scanning line are reset to be at the low level.

Figure 4:
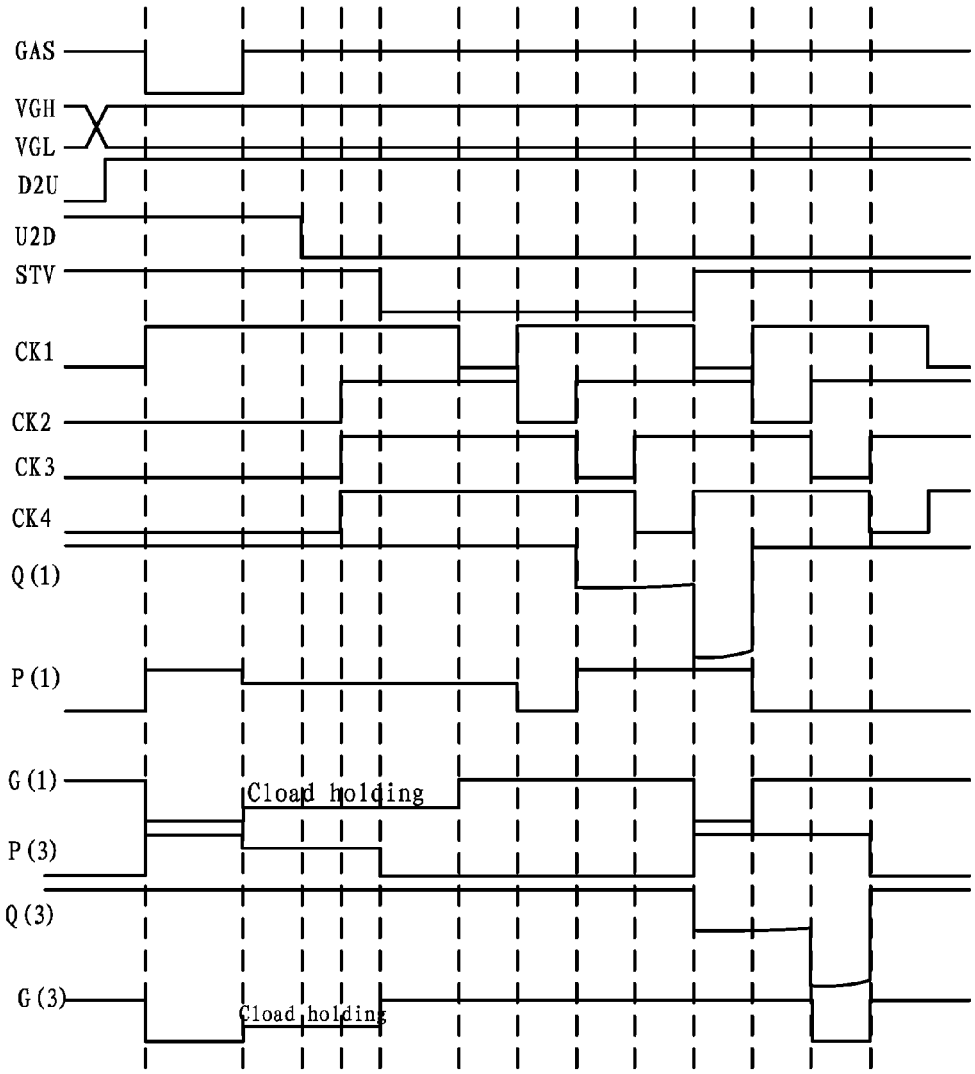
FIG. 4 is a timing diagram of the GOA unit of the GOA circuit of FIG. 2.

FIG. 4 is a timing diagram of the GOA unit of the GOA circuit of FIG. 2. In this embodiment, the GOA circuit is formed by GOA units at odd levels, and the GOA circuit is a PMOS circuit. As shown in FIG. 4, when the GAS are valid, i.e., at the low level, the GOA circuit 20 implements the All Gate On function, and the gate driving signals G(2N+1) corresponding to the horizontal scanning lines at odd level output the low level signals. When the All Gate On function is completed, the gate driving signals G(2N+1) corresponding to the horizontal scanning line at odd levels are not transited to the high level immediately, but remains the low level signals of the bootstrap capacitance (Cload) due to the bootstrap capacitance (Cload).

In an example, the GOA circuit adopts forward driven method. Before the third clock signals (CK3) is valid, if the gate driving signals corresponding to the horizontal scanning line at odd level cannot be discharged to the high level, the horizontal scanning line at the odd levels, except for the first level, may generate redundant pulse signals. Specifically, the horizontal scanning line at the first level is driven by the GOA unit at the first level. As the level signals of the GOA unit at the first level are the turn-on pulse signals (STV), the GOA unit at the first level may be driven normally, that is, the redundant pulse signals are not generated. The horizontal scanning line at the third level is driven by the GOA unit at the third level, and the level signals of the GOA unit at the third level are the gate driving signals G(1) of the GOA unit at the first level. When the first clock signals (CK1) are at the low level, the gate driving signals G(1) remains the low level signals of the Cload holding, and the low level signals of the gate driving signals G(1) are transmitted to the gate signal point Q(3) of the GOA unit at the third level. As such, the GOA unit 21 at the third level operates before the GOA unit 21 at the first level. In addition, the gate driving signals G(3) outputted by the GOA unit 21 at the third level generate one redundant pulse, which continuously affect the gate driving signals of the GOA unit 21 at the next level. Basing on the same reasons, when the first clock signals (CK1) are valid, the gate driving signals of the GOA units at the seventh, the eleventh, . . . , the (4N+3)-th levels may generate redundant pulses.

To avoid the above issues, as shown in FIG. 4, after the All Gate On function is completed and before the first clock signals (CK1) are valid, the turn-on pulse signals (STV) are configured to be at the low level. In addition, after the first clock signals (CK1), the second clock signals (CK2), the third clock signals (CK3), and the fourth clock signals (CK4) are valid in sequence, the turn-on pulse signals (STV) transit from the low level to the high level. When the turn-on pulse signals (STV) are at the low level, the first controllable transistor (T1) is turned on, the GOA unit 21 at the third, the fifth, and the (2N+1)-th levels transit from the high level to the low level. As such, before the third clock signals (CK3) are valid, the gate driving signals G(2N+1) transits to be at high level, which avoids the generation of the redundant pulse signals. Afterward, the first clock signals (CK1), the second clock signals (CK2), the third clock signals (CK3), and the fourth clock signals (CK4) are driven normally in sequence so as to drive the GOA circuit 20, and thus the horizontal scanning line may be normally charged.

Figure 5:
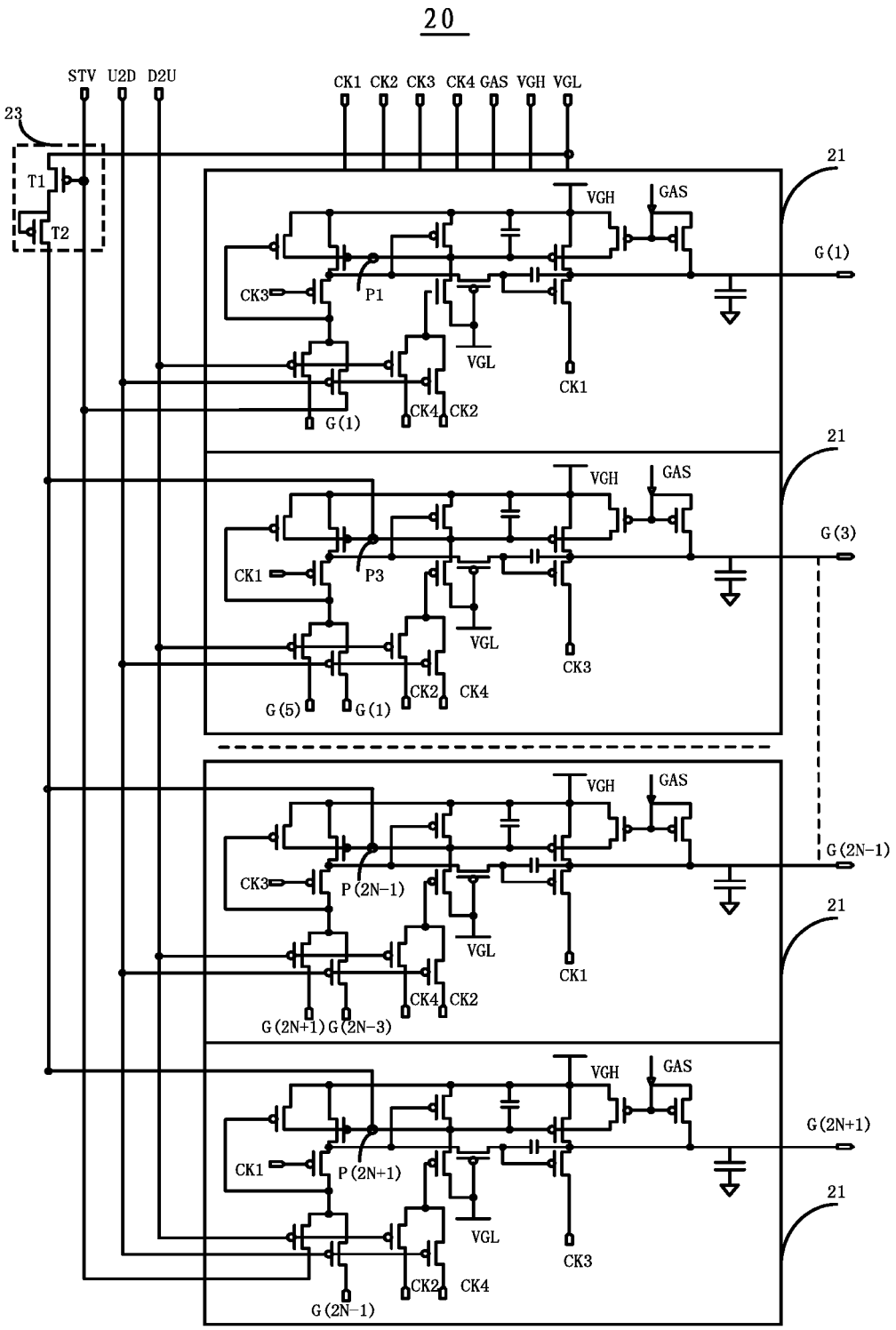
FIG. 5 is a schematic view of the GOA circuit in accordance with a third embodiment.

FIG. 5 is a schematic view of the GOA circuit in accordance with a third embodiment. In this embodiment, the GOA circuit is formed by cascaded GOA units at odd levels, and the GOA circuit is a PMOS circuit. The difference between the second embodiment and the third embodiment will be described hereinafter.

As shown in FIG. 5, a control module 23 includes a first controllable transistor (T1) and a second controllable transistor (T2). The first end of the first controllable transistor (T1) connects with the negative-voltage constant-voltage source (VGL), the second end of the first controllable transistor (T1) connects with the signal line of the turn-on pulse signals (STV), and the third end of the first controllable transistor (T1) connects to the first end and the second end of the second controllable transistor (T2). The third end of the second controllable transistor (T2) respectively connects with the common signal points P(2N+1) of each of the GOA units 21 at all of the levels, except for the first level.

In the embodiment, the first controllable transistor (T1) is the PMOS transistor, the first, second, and third ends of the first controllable transistor (T1) correspond to the drain, gate and source of the PMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the low level such that the gate driving signals G(2N+1) of the horizontal scanning line are reset to be at the high level.

In other embodiments, when the GOA circuit is the NMOS circuit, the first controllable transistor (T1) and the second controllable transistor (T2) may be NMOS transistor. The first, the second, and the third ends of the first controllable transistor (T1) and the second controllable transistor (T2) may respectively correspond to the drain, the gate, and the source of the NMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the high level such that the gate driving signals G(2N+1) of the horizontal scanning line are reset to be at the low level.

Figure 6:
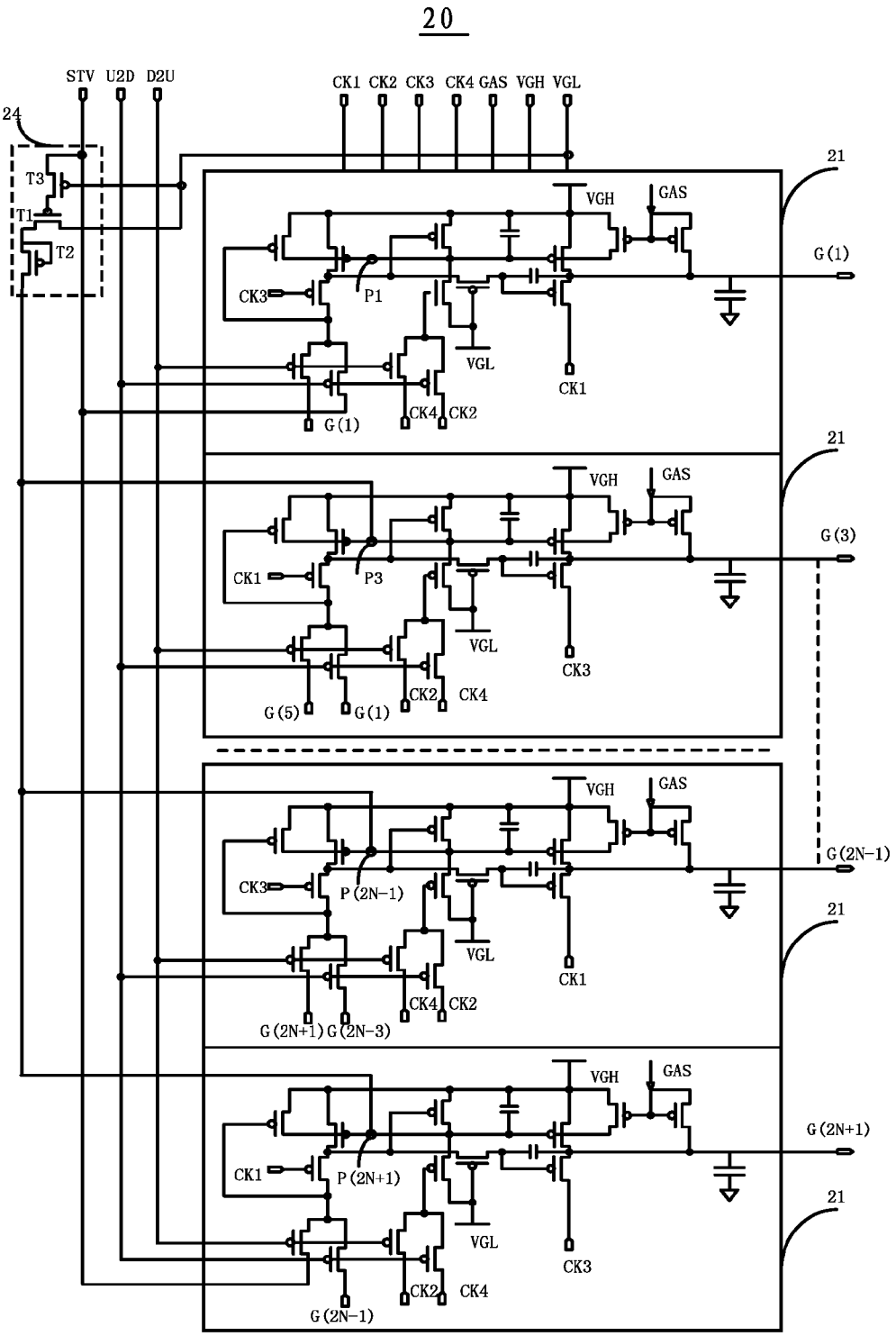
FIG. 6 is a schematic view of the GOA circuit in accordance with a fourth embodiment.

FIG. 6 is a schematic view of the GOA circuit in accordance with a fourth embodiment. In this embodiment, the GOA circuit is formed by cascaded GOA units at odd levels, and the GOA circuit is a PMOS circuit. The difference between the second embodiment and the fourth embodiment will be described hereinafter.

As shown in FIG. 6, the control module 24 includes a first controllable transistor (T1), a second controllable transistor (T2), and a third controllable switch (T3). A first end of the third controllable switch (T3) connects to the turn-on pulse signals (STV), a second end of the third controllable switch (T3) connects to the negative-voltage constant-voltage source (VGL), a third end of the third controllable switch (T3) connects to the second end of the first controllable transistor (T1), the first end of the first controllable transistor (T1) connects to the negative-voltage constant-voltage source (VGL), the third end of the first controllable transistor (T1) connects to the first end and the second end of the second controllable transistor (T2), the third end of the second controllable transistor (T2) respectively connects to the common signal points P(2N+1) of each of the GOA units 21, except for the first GOA unit 21.

In the embodiment, the first controllable transistor (T1) and the second controllable transistor (T2) are PMOS transistors, the first, second, and third ends of the first controllable transistor (T1) and the second controllable transistor (T2) may correspond to the drain, gate and source of the PMOS transistor. When the turn-on pulse signals (STV) are turned on, the turn-on pulse signals (STV) and the negative-voltage constant-voltage source (VGL) controls the common signal points P(2N+1) of each of the GOA units, except for the first GOA unit, to be at the low level such that the gate driving signals G(2N+1) of the horizontal scanning line are reset to be at the high level.

In other embodiments, when the GOA circuit is the NMOS circuit, the first controllable transistor (T1) and the second controllable transistor (T2) may be NMOS transistors. The first, the second, and the third ends of the first controllable transistor (T1) and the second controllable transistor (T2) may respectively correspond to the drain, the gate, and the source of the NMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the high level such that the gate driving signals G(2N+1) of the horizontal scanning line are reset to be at the low level.

Figure 7:
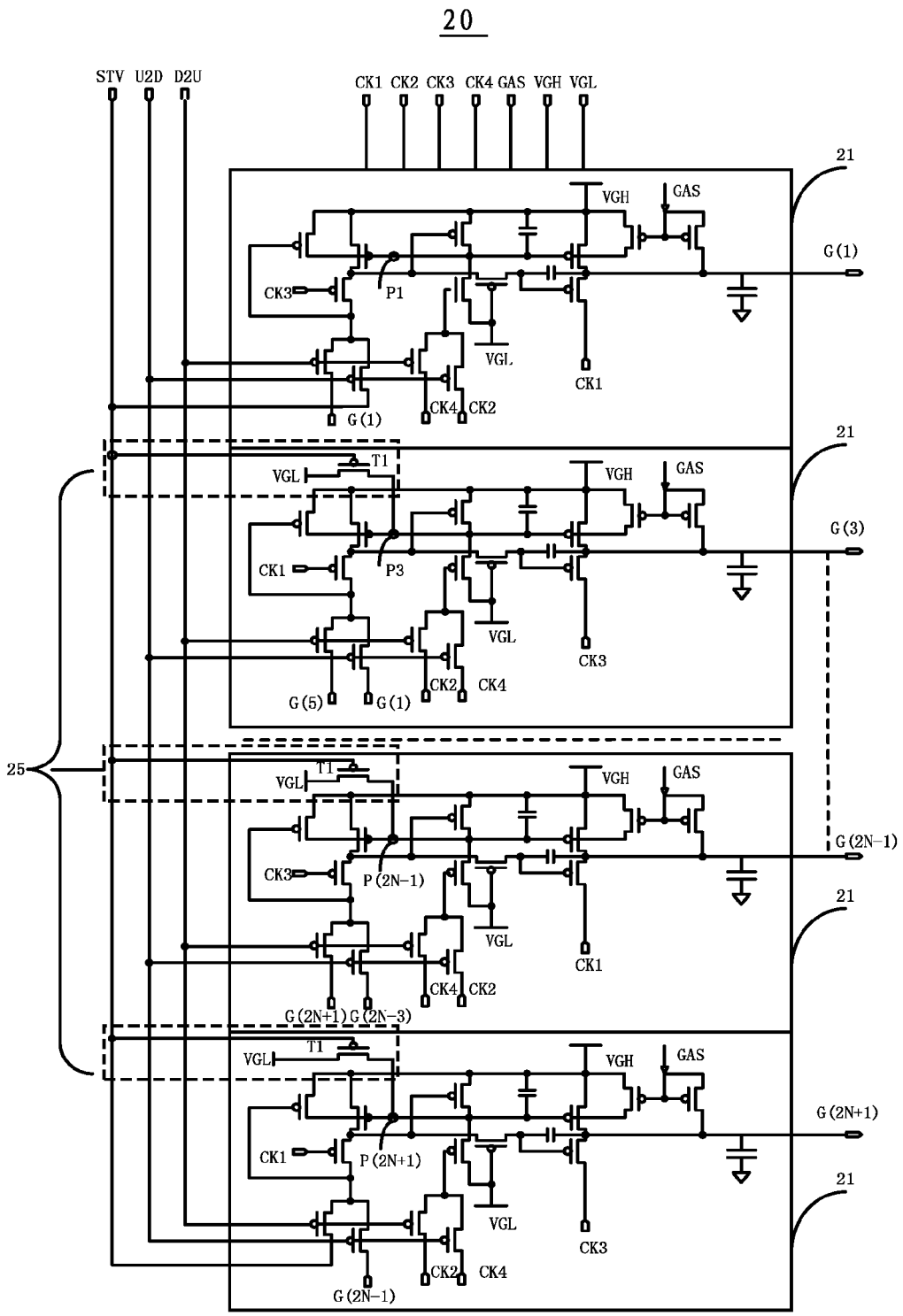
FIG. 7 is a schematic view of the GOA circuit in accordance with a fifth embodiment.

FIG. 7 is a schematic view of the GOA circuit in accordance with a fifth embodiment. In this embodiment, the GOA circuit is formed by cascaded GOA units at odd levels, and the GOA circuit is a PMOS circuit. The difference between the fifth embodiment and the second embodiment will be described hereinafter.

As shown in FIG. 7, the control module 25 includes a plurality of first controllable transistors (T1) corresponding to each of the GOA units 21 one by one except for the first GOA unit, negative-voltage constant-voltage sources (VGL) connecting with the first ends of the first controllable transistors (T1). The second ends of the first controllable transistors (T1) connect with the signal line of the turn-on pulse signals (STV). The third ends of the first controllable transistors (T1) connect with the common signal points P(2N+1) of the corresponding GOA unit 21.

In the embodiment, the first controllable transistor (T1), the second controllable transistor (T2), and the third controllable switch (T3) are PMOS transistors, the first, second, and third ends of the first controllable transistor (T1), the second controllable transistor (T2), and the third controllable switch (T3) may correspond to the drain, gate and source of the PMOS transistor. When the turn-on pulse signals (STV) are turned on, the turn-on pulse signals (STV) and the negative-voltage constant-voltage source (VGL) controls the common signal points P(2N+1) of each of the GOA units, except for the first GOA unit, to be at the low level such that the gate driving signals G(2N+1) of the horizontal scanning line are reset to be at the high level.

In other embodiments, when the GOA circuit is the NMOS circuit, the first controllable transistor (T1), the second controllable transistor (T2), and the third controllable switch (T3) may be NMOS transistors. The first, the second, and the third ends of the first controllable transistor (T1), the second controllable transistor (T2), and the third controllable switch (T3) may respectively correspond to the drain, the gate, and the source of the NMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the high level such that the gate driving signals G(2N+1) of the horizontal scanning line are reset to be at the low level.

Figure 8:
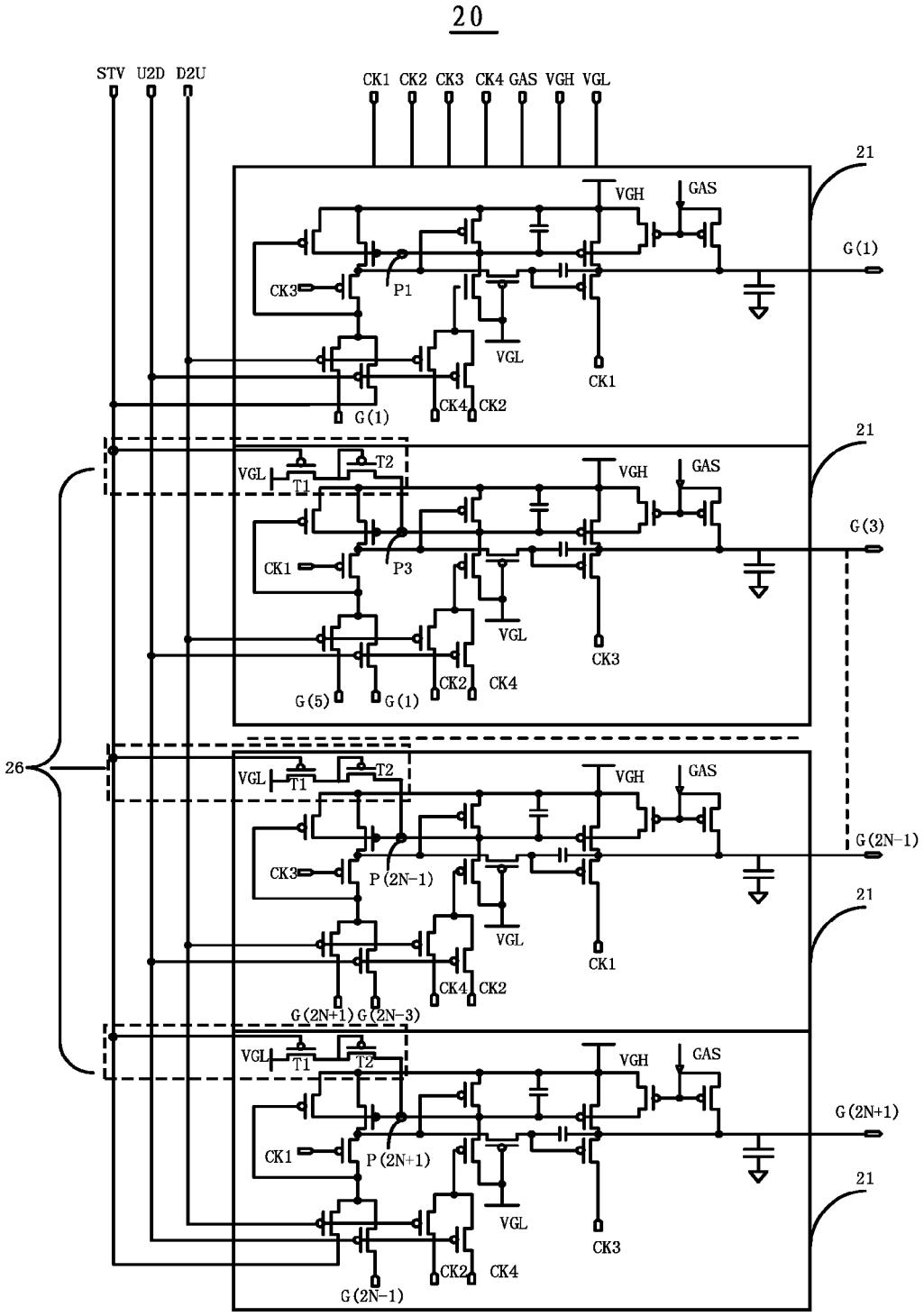
FIG. 8 is a schematic view of the GOA circuit in accordance with a sixth embodiment.

FIG. 8 is a schematic view of the GOA circuit in accordance with a sixth embodiment. In this embodiment, the GOA circuit is formed by cascaded GOA units at odd levels, and the GOA circuit is a PMOS circuit. The difference between the sixth embodiment and the second embodiment will be described hereinafter.

As shown in FIG. 8, the control module 26 includes a plurality of first controllable transistors (T1) and a plurality of second controllable transistors (T2) corresponding to each of the GOA units 21 one by one except for the first GOA unit. The first ends of the first controllable transistors (T1) connects to the negative-voltage constant-voltage source (VGL), the second ends of the first controllable transistor (T1) connect to the signal line of the turn-on pulse signals (STV), and the third ends of the third controllable transistors (T3) connect to the first end and the second end of the second controllable transistor (T2), the third ends of the second controllable transistors (T2) connect to the gate signal points of the corresponding GOA unit.

In the embodiment, the first controllable transistor (T1) and the second controllable transistor (T2) are PMOS transistors, the first, second, and third ends of the first controllable transistor (T1) and the second controllable transistor (T2) may correspond to the drain, gate and source of the PMOS transistor. When the turn-on pulse signals (STV) are turned on, the turn-on pulse signals (STV) and the negative-voltage constant-voltage source (VGL) controls the common signal points P(2N+1) of each of the GOA units, except for the first GOA unit, to be at the low level such that the gate driving signals G(2N+1) of the horizontal scanning line are reset to be at the high level.

In other embodiments, when the GOA circuit is the NMOS circuit, the first controllable transistor (T1) and the second controllable transistor (T2) may be NMOS transistors. The first, the second, and the third ends of the first controllable transistor (T1) and the second controllable transistor (T2) may respectively correspond to the drain, the gate, and the source of the NMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the high level such that the gate driving signals G(2N+1) of the horizontal scanning line are reset to be at the low level.

Figure 9:
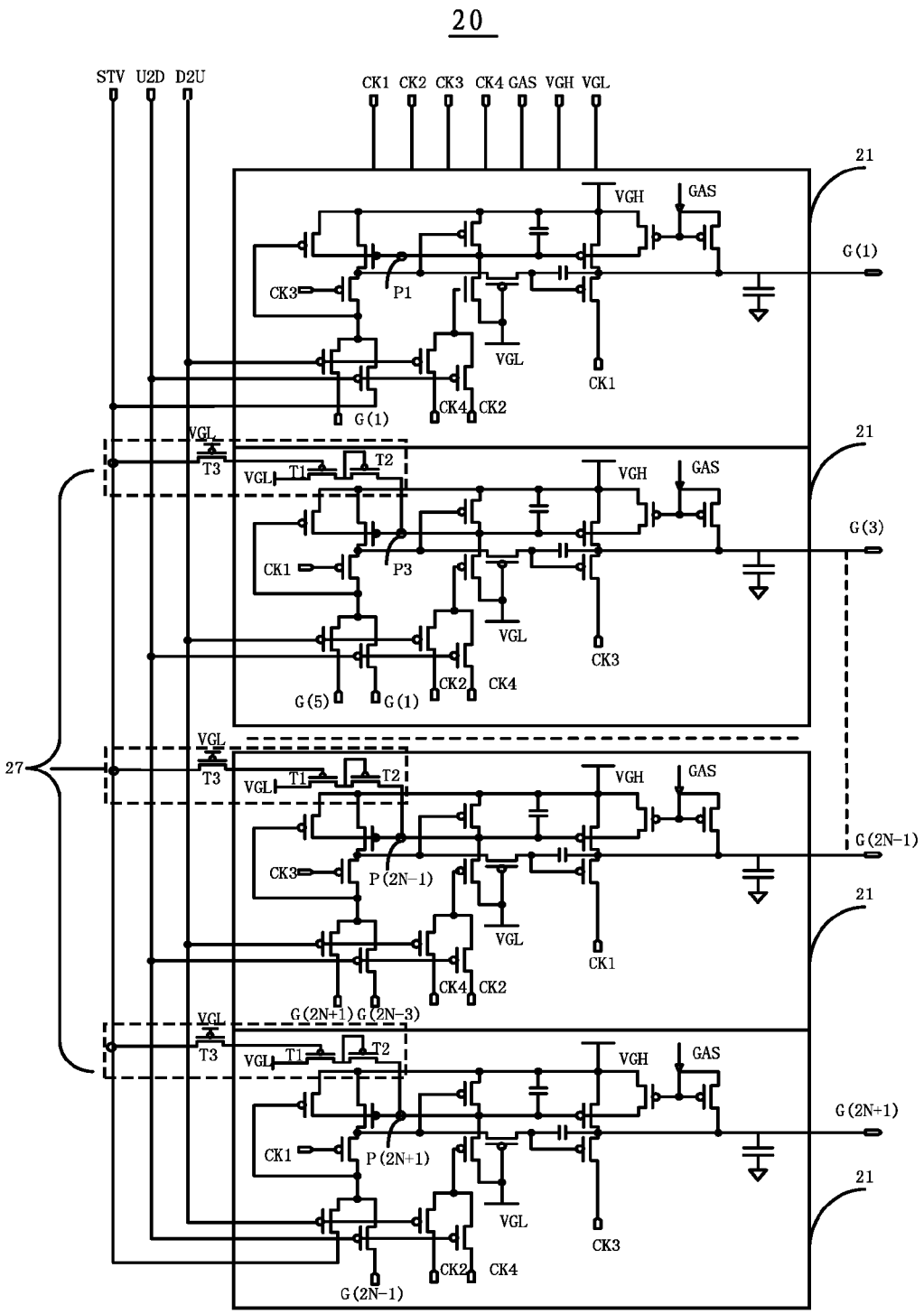
FIG. 9 is a schematic view of the GOA circuit in accordance with a seventh embodiment.

FIG. 9 is a schematic view of the GOA circuit in accordance with a seventh embodiment. In this embodiment, the GOA circuit is formed by cascaded GOA units at odd levels, and the GOA circuit is a PMOS circuit. The difference between the seventh embodiment and the second embodiment will be described hereinafter.

As shown in FIG. 9, the control module 27 includes a plurality of first controllable transistors (T1), a plurality of second controllable transistors (T2), and a plurality of third controllable transistors (T3) corresponding to each of the GOA units 21 one by one except for the first GOA unit. The first ends of the third controllable transistors (T3) connect to the turn-on pulse signals (STV), the second ends of the third controllable transistors (T3) connect to the negative-voltage constant-voltage source (VGL), the third ends of the third controllable transistors (T3) connect to the second ends of the first controllable transistors (T1), the first ends of the first controllable transistors (T1) connect to the negative-voltage constant-voltage source (VGL), the third ends of the first controllable transistors (T1) connect to the first ends and the second ends of the second controllable transistor (T2), and the third ends of the second controllable transistors (T2) respectively connect to the common signal points P(2N+1) of the corresponding GOA unit 21.

In the embodiment, the first controllable transistor (T1) and the second controllable transistor (T2) are PMOS transistors, the first, second, and third ends of the first controllable transistor (T1) and the second controllable transistor (T2) may correspond to the drain, gate and source of the PMOS transistor. When the turn-on pulse signals (STV) are turned on, the turn-on pulse signals (STV) and the negative-voltage constant-voltage source (VGL) controls the common signal points P(2N+1) of each of the GOA units, except for the first GOA unit, to be at the low level such that the gate driving signals G(2N+1) of the horizontal scanning line are reset to be at the high level.

In other embodiments, when the GOA circuit is the NMOS circuit, the first controllable transistor (T1) and the second controllable transistor (T2) may be NMOS transistors. The first, the second, and the third ends of the first controllable transistor (T1) and the second controllable transistor (T2) may respectively correspond to the drain, the gate, and the source of the NMOS transistor. When the turn-on pulse signals (STV) are turned on, the turn-on pulse signals (STV) and the negative-voltage constant-voltage source (VGL) controls the common signal point P(2N+1) of each of the GOA units, except for the first GOA unit, to be at the high level such that the gate driving signals G(2N+1) of the horizontal scanning line are reset to be at the low level.

In addition, the timing diagram of the GOA circuit in the third to the seventh embodiments, as shown in FIGS. 5-9, are the same with that of the second embodiment, as shown in FIG. 2, and thus will be omitted hereinafter.

It can be understood by persons skilled in the art that the LCD includes the GOA circuit formed by the cascaded GOA units at odd levels and the GOA circuit formed by the cascaded GOA units at even levels. As the operations of GOA circuit formed by the cascaded GOA units at odd levels are similar to that of the GOA circuit formed by the cascaded GOA units at even levels, and thus are omitted hereinafter.

Figure 10:
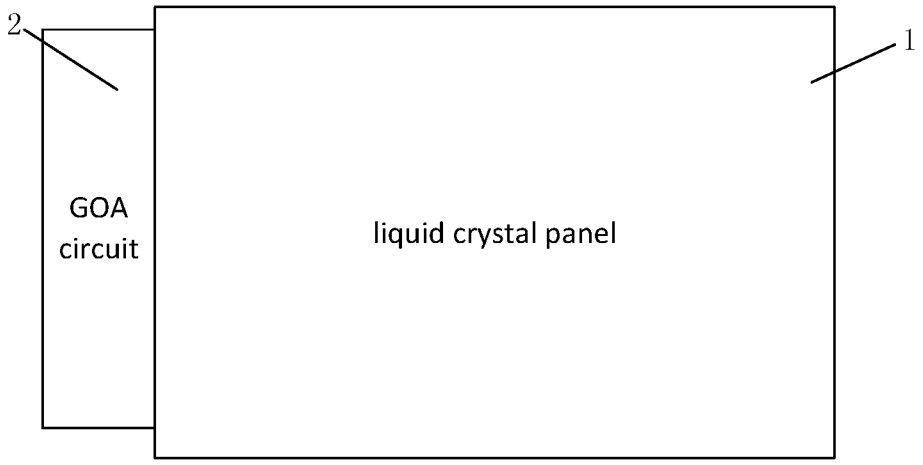
FIG. 10 is a schematic view of the LCD in accordance with one embodiment.

In one embodiment, a LCD includes the above GOA circuit. FIG. 10 is a schematic view of the LCD in accordance with one embodiment. In the embodiment, the LCD includes a liquid crystal panel 1 and a GOA circuit 2 at the lateral side of the liquid crystal panel 1.

In view of the above, after the horizontal scanning lines are fully charged by the GOA circuit, the gate driving signals of the horizontal scanning line are controlled by turning on the turn-on pulse signals (STV) to be reset to be at the first level, i.e., the invalid level. As such, the horizontal scanning line is prevented from generating redundant pulse signals before the first gate driving signals are outputted, which guarantee the normal operations of the GOA circuit.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A gate driver on array (GOA) circuit of liquid crystal devices (LCDs), comprising: a plurality of cascaded GOA units, each of the cascaded GOA units is configured for charging corresponding horizontal scanning lines within a display area when being driven by a first level clock, a second level clock, a first control clock, and a second control clock, the first level clock and the second level clock are configured for controlling an input of level signals of the GOA unit and for controlling generation of gate driving signals, the first control clock and the second control clock are configured for controlling the gate driving signals to be at a first level, and wherein the level signals are turn-on pulse signals or the gate driving signals of adjacent GOA units; and after the horizontal scanning lines have been charged completely by the GOA circuit, a control module is configured for resetting the gate driving signals, except for first gate driving signals, to be the first level via the turn-on pulse signals and a negative-voltage constant-voltage source, before the first gate driving signals are outputted, the horizontal scanning lines are prevented from generating redundant pulse signals, at the same time, load on a signal line of the turn-on pulse signals is decreased, the negative-voltage constant-voltage source is configured for providing constant low level signals for each of the GOA units;

wherein the GOA unit comprises a forward-backward scanning unit, an input control unit, a pull-up maintaining unit, an output control unit, a GAS signal operation unit, and a bootstrap capacitance unit;

the forward-backward scanning unit is configured for controlling a forward driven method or a backward driven method of the GOA circuit to maintain the common signal point at a second level in response to the first control clock or the second control clock;

the input control unit is configured for charging the gate signal point after the first level clock controls an input of the level signals;

the pull-up maintaining unit is configured for maintaining the gate signal point to be at the first level during a non-operation period in accordance with the common signal point;

the output control unit controls the output of the gate driving signals corresponding to the gate signal point in accordance with the second level clock;

the GAS signal operation unit controls the gate driving signals to be at the second level so as to charge the horizontal scanning line corresponding to the GOA unit; and the bootstrap capacitance unit lifts a voltage of the gate signal point; and wherein the control module comprises a first controllable transistor, a second controllable transistor, and a third controllable switch, a first end of the third controllable switch connects to the turn-on pulse signals, a second end of the third controllable switch connects to the negative-voltage constant-voltage source, a third end of the third controllable switch connects to a second end of the first controllable transistor, a first end of the first controllable transistor connects to the negative-voltage constant-voltage source, a third end of the first controllable transistor connects to a first end and a second end of the second controllable transistor, a third end of the second controllable transistor respectively connects to the common signal points of each of the GOA units, except for the first GOA unit.

2. The GOA circuit as claimed in claim 1, wherein the forward-backward scanning unit comprises a first transistor, a second transistor, a third transistor and a fourth transistor, a gate of the first transistor receives the first scanning control signals, a source of the first transistor receives the gate driving signals outputted by the GOA unit at the next level, a gate of the second transistor receives the second scanning control signals, a source of the second transistor receives the gate driving signals outputted from the GOA unit at the previous level, drains of the first transistor and the second transistor are connected and then connect to the input control unit, a gate of the third transistor receives the first scanning control signals, a source of the third transistor receives the first control clock, a gate of the fourth transistor receives the second scanning control signals, a source of the fourth transistor receives the second control clock, drains of the third transistor and the fourth transistor are connected and then connect with the pull-up maintaining unit;

the input control unit comprises a fifth transistor, a gate of the fifth transistor receives the first level clock, a source of the fifth transistor connects with drains of the first transistor and the second transistor, and a drain of the fifth transistor connects with the gate signal point;

the pull-up maintaining unit comprises a sixth transistor, a seventh transistor, a ninth transistor, and a tenth transistor, and a first capacitor, a gate of the sixth transistor connects with the common signal point, a source of the sixth transistor connects with a drain of the fifth transistor, a drain of the sixth transistor connects with a first constant voltage source, a gate of the seventh transistor connects with the drain of the fifth transistor, a source of the seventh transistor connects with the common signal point, a drain of the seventh transistor connects with the first constant voltage source, a gate of the ninth transistor connects with the drains of the third transistor and the fourth transistor, a source of the ninth transistor connects with the second constant voltage source, a drain of the ninth transistor connects with the common signal point, a gate of the tenth transistor connects with the common signal point, a source of the tenth transistor connects with the gate driving signals, a drain of the tenth transistor connects with the first constant voltage source, one end of the first capacitor connects with the first constant voltage source, and the other end of the first capacitor connects with the common signal point;

the output control unit comprises an eleventh transistor and a second capacitor, a gate of the eleventh transistor connects with the gate signal point, a drain of the eleventh transistor connects with the gate signal point, a source of the eleventh transistor receives the second level clock, one end of the second capacitor connects with the gate signal point, and the other end of the second capacitor connects with the gate driving signals;

the GAS signal operation unit comprises a thirteenth transistor and a fourteenth transistor, a gate of the thirteenth transistor and a gate and a drain of the fourteenth transistor receive the GAS signals, a drain of the thirteenth transistor receives the first constant voltage source, a source of the thirteenth transistor connects with the common signal point, and a source of the fourteenth transistor connects with the gate driving signals;

the bootstrap capacitance unit comprises a bootstrap capacitance, one end of the bootstrap capacitance connects with the gate driving signals, and the other end of the bootstrap capacitance connects with ground signals;

the GOA unit further comprises a regulation unit and a pull-up auxiliary unit, the regulation unit comprises an eighth transistor connecting between the source of the fifth transistor and the gate signal point, a gate of the eighth transistor connects with the second constant voltage source, a drain of the eighth transistor connects with the drain of the fifth transistor, and a source of the eighth transistor connects with the gate signal point; and the pull-up auxiliary unit comprises a twelfth transistor, a gate of the twelfth transistor connects with drains of the first transistor and the second transistor, a source of the twelfth transistor connects with the common signal point, and a drain of the twelfth transistor connects with a positive-voltage constant-voltage source.

3. A liquid crystal device (LCD), comprising: a GOA circuit having a plurality of cascaded GOA units, each of the cascaded GOA units is configured for charging corresponding horizontal scanning lines within a display area when being driven by a first level clock, a second level clock, a first control clock, and a second control clock, the first level clock and the second level clock are configured for controlling an input of level signals of the GOA unit and for controlling generation of gate driving signals, the first control clock and the second control clock are configured for controlling the gate driving signals to be at a first level, and wherein the level signals are turn-on pulse signals or the gate driving signals of adjacent GOA units;

after the horizontal scanning lines have been charged completely by the GOA circuit, a control module is configured for resetting the gate driving signals, except for first gate driving signals, to be the first level via the turn-on pulse signals and a negative-voltage constant-voltage source, before the first gate driving signals are outputted, the horizontal scanning lines are prevented from generating redundant pulse signals, at the same time, load on a signal line of the turn-on pulse signals is decreased, the negative-voltage constant-voltage source is configured for providing constant low level signals for each of the GOA units;

wherein the GOA unit comprises a forward-backward scanning unit, an input control unit, a pull-up maintaining unit, an output control unit, a GAS signal operation unit, and a bootstrap capacitance unit;

the forward-backward scanning unit is configured for controlling a forward driven method or a backward driven method of the GOA circuit to maintain a common signal point at a second level in response to the first control clock or the second control clock;

the input control unit is configured for charging the gate signal point after the first level clock controls an input of the level signals;

the pull-up maintaining unit is configured for maintaining the gate signal point Q to be at the first level during a non-operation period in accordance with the common signal point;

the output control unit controls the output of the gate driving signals corresponding to the gate signal point in accordance with the second level clock;

the GAS signal operation unit controls the gate driving signals to be at the second level so as to charge the horizontal scanning line corresponding to the GOA unit;

the bootstrap capacitance unit lifts a voltage of the gate signal point; and wherein the control module comprises a first controllable transistor, a second controllable transistor, and a third controllable switch, a first end of the third controllable switch connects to the turn-on pulse signals, a second end of the third controllable switch connects to the negative-voltage constant-voltage source, a third end of the third controllable switch connects to a second end of the first controllable transistor, a first end of the first controllable transistor connects to the negative-voltage constant-voltage source, a third end of the first controllable transistor connects to a first end and a second end of the second controllable transistor, a third end of the second controllable transistor respectively connects to the common signal points of each of the GOA units, except for the first GOA unit.

4. The LCD as claimed in claim 3, wherein the forward-backward scanning unit comprises a first transistor, a second transistor, a third transistor and a fourth transistor, a gate of the first transistor receives the first scanning control signals, a source of the first transistor receives the gate driving signals outputted by the GOA unit at the next level, a gate of the second transistor receives the second scanning control signals, a source of the second transistor receives the gate driving signals outputted from the GOA unit at the previous level, drains of the first transistor and the second transistor are connected and then connect to the input control unit, a gate of the third transistor receives the first scanning control signals, a source of the third transistor receives the first control clock, a gate of the fourth transistor receives the second scanning control signals, a source of the fourth transistor receives the second control clock, drains of the third transistor and the fourth transistor are connected and then connect with the pull-up maintaining unit;

the input control unit comprises a fifth transistor, a gate of the fifth transistor receives the first level clock, a source of the fifth transistor connects with drains of the first transistor and the second transistor, and a drain of the fifth transistor connects with the gate signal point;

the pull-up maintaining unit comprises a sixth transistor, a seventh transistor, a ninth transistor, and a tenth transistor, and a first capacitor, a gate of the sixth transistor connects with the common signal point, a source of the sixth transistor connects with a drain of the fifth transistor, a drain of the sixth transistor connects with the first constant voltage source, a gate of the seventh transistor connects with the drain of the fifth transistor, a source of the seventh transistor connects with the common signal point, a drain of the seventh transistor connects with a first constant voltage source, a gate of the ninth transistor connects with the drains of the third transistor and the fourth transistor, a source of the ninth transistor connects with the second constant voltage source, a drain of the ninth transistor connects with the common signal point, a gate of the tenth transistor connects with the common signal point, a source of the tenth transistor connects with the gate driving signals, a drain of the tenth transistor connects with the first constant voltage source, one end of the first capacitor connects with the first constant voltage source, and the other end of the first capacitor connects with the common signal point;

the output control unit comprises an eleventh transistor and a second capacitor, a gate of the eleventh transistor connects with the gate signal point, a drain of the eleventh transistor connects with the gate signal point, a source of the eleventh transistor receives the second level clock, one end of the second capacitor connects with the gate signal point, and the other end of the second capacitor connects with the gate driving signals;

the GAS signal operation unit comprises a thirteenth transistor and a fourteenth transistor, a gate of the thirteenth transistor and a gate and drain of the fourteenth transistor receive the GAS signals, a drain of the thirteenth transistor receives the first constant voltage source, a source of the thirteenth transistor connects with the common signal point, and a source of the fourteenth transistor connects with the gate driving signals;

the bootstrap capacitance unit comprises a bootstrap capacitance, one end of the bootstrap capacitance connects with the gate driving signals, and the other end of the bootstrap capacitance connects with ground signals;

the GOA unit further comprises a regulation unit and a pull-up auxiliary unit, the regulation unit comprises an eighth transistor connecting between the source of the fifth transistor and the gate signal point, a gate of the eighth transistor connects with the second constant voltage source, a drain of the eighth transistor connects with the drain of the fifth transistor, and a source of the eighth transistor connects with the gate signal point; and the pull-up auxiliary unit comprises a twelfth transistor, a gate of the twelfth transistor connects with drains of the first transistor and the second transistor, a source of the twelfth transistor connects with the common signal point, and a drain of the twelfth transistor connects with a positive-voltage constant-voltage source.

* * * * *